United States Patent [19]

Barnaby

[11] 4,253,134

[45] Feb. 24, 1981

[54] ILLUMINATED SOCKET WRENCH EXTENSION

[76] Inventor: Horace T. Barnaby, 2449 Laurel Brook, Follston, Md.

[21] Appl. No.: 945,474

[22] Filed: Sep. 25, 1978

[51] Int. Cl.[3] ..... B25K 23/18

[52] U.S. Cl. ..... 362/119; 362/120

[58] Field of Search ..... 362/119, 120

[56] References Cited

U.S. PATENT DOCUMENTS

| | | | |
|---|---|---|---|
| 2,783,364 | 2/1957 | Wood | 362/119 |
| 3,590,235 | 6/1971 | Leo | 362/119 |

*Primary Examiner*—Donald P. Walsh

*Attorney, Agent, or Firm*—William F. Frank

[57] ABSTRACT

The present invention is an improved extension for use with socket wrenches. The invention comprises a generally cylindrical housing having an axial hollow into which is inserted a light source and batteries. The ratchet or handle end of the extension contains a biased switch which is closed when the handle or ratchet is inserted into that end. The socket receiving end has a socket retaining ball formed from a metal strip which is attached to the outer surface of the socket receiving end in a recess. The open end of the bore in the extension is closed by a plastic disc. The extension may contain one, two, or more batteries depending upon its length.

5 Claims, 10 Drawing Figures

ILLUMINATED SOCKET WRENCH EXTENSION

SUMMARY OF THE INVENTION

This invention relates to wrenches, and more particularly, to that class of tools known as socket wrenches, with special reference to an article of this character wherein the same embodies a stem or shank that is adapted to have detachably positioned upon one end thereof, socket elements of different shapes and sizes, and that is adapted for detachable engagement at its opposite end with a desirable form of ratchet wrench or handle whereby nuts of varying shapes and sizes may be readily worked upon.

Those working around machinery, automobiles, heavy equipment, and like objects having nut and bolt couplings are frequently plagued with the inability to see exactly where the particular nut is due to the lack of light. Use of flashlights or mechanics' extension lights has been the only solution, generally, to date. This is not always satisfactory because there are times when it is not possible to get both arms in or under the machinery to shine a light on the nut, or the light will shine in the mechanic's face, or the heat from the light will be dangerous. This has been recognized in connection with screwdrivers which are provided with a flashlight body to which is affixed a screwdriver blade, and the light is operated by a switch on the flashlight body. U.S. Pat. No. 2,341,375 discloses a socket wrench that has at least two sockets with arms emanating from a central boss. The boss contains a battery source and a manual switch, and the battery is connected to a light source at the end of the extending arm, and then the socket is attached permanently thereto.

The new and improved invention provides a tool coupling of simple and inexpensive construction having the socket engaging tip thereof equipped with an electric light so as to illuminate the work when the wrench is used at night or in inaccessible dark places.

The invention also provides an improved coupling, comprising a shank of novel arrangement provided with a hollow core to house and protect the battery(s), and electric light, operatively connected with the controlling switch.

Further, the invention provides a contact switch, automatically activated by the attachable desired form of ratchet wrench or handle, controlling the illumination of the socket engaging tip.

Lastly, the invention generally improves this class of devices so as to increase their utility and efficiency.

With the above and other objects in view, the invention consists in general of certain novel details of construction and combinations of parts hereinafter fully described, illustrated in the accompanying drawings, and specifically claimed.

In the drawings, like reference characters indicate corresponding parts throughout the several views.

DETAILED DESCRIPTION OF THE INVENTION

Figure 1:
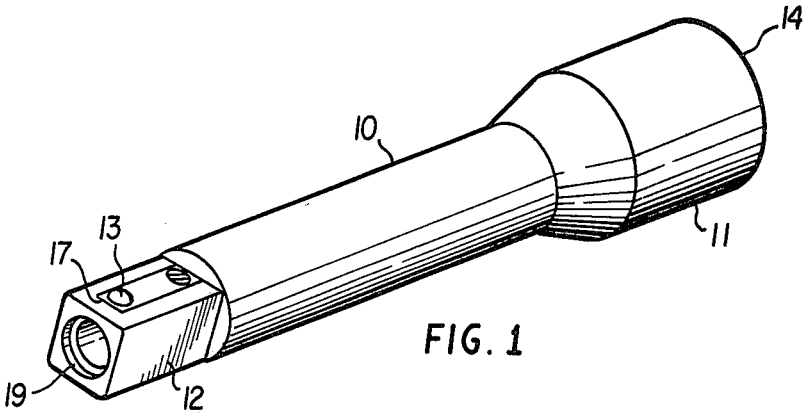
FIG. 1 is a perspective of the socket wrench extension of the present invention.
Figure 2:
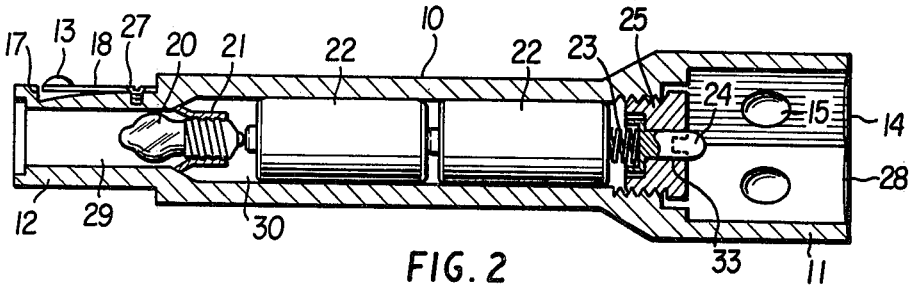
FIG. 2 is a cross-sectional view in elevation of the extension with portions being broken away to show the illuminating interior construction of the invention.
Figure 3:
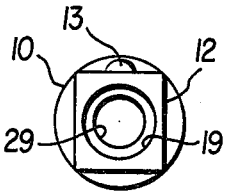
FIG. 3 is an elevation view of the socket receiving end.
Figure 4:
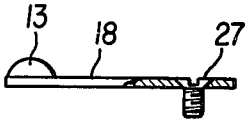
FIG. 4 is an enlarged partial sectional view of the socket retaining element.
Figure 5:
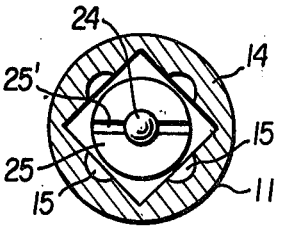
FIG. 5 is a cross-sectional view in elevation of the handle receiving end.
Figure 6:
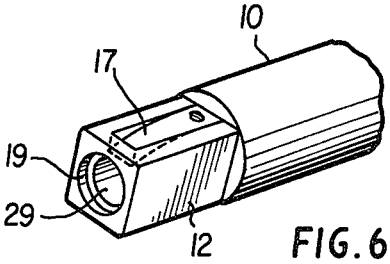
FIG. 6 is an enlarged perspective view of the socket receiving end.
Figure 7:
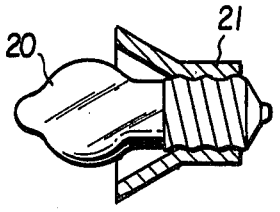
FIG. 7 is an enlarged view in partial section of the light and light receiving socket.
Figure 8:
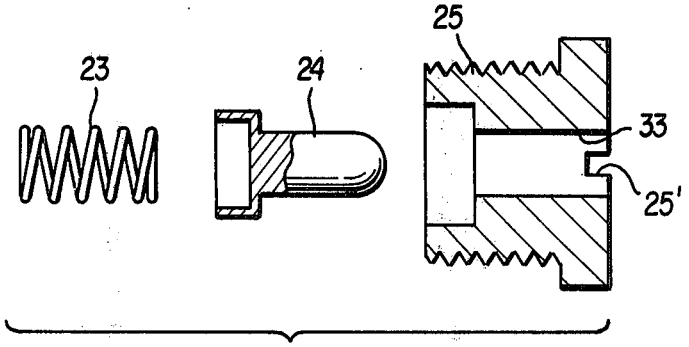
FIG. 8 is a disassembled view of switch and battery retaining screw.

The improved socket wrench forming the subject matter of the present invention comprises a socket wrench extension formed of metal or other suitable material and having a shank 10 of novel arrangement provided with a hollow core 30 to house the battery(s) 22, which may be one, two, or more depending on the length of the extension, and electric light 20 which is operatively connected with the controlling switch (FIG. 8). The controlling switch in FIG. 8 is comprised of a battery retaining spring 23, a metal push botton 24, and a threaded housing of plastic or other suitable material 25 which has a hole therein 33, which is sized to accept the push button 24. This switch is of the momentary contact type. Slot 25' is provided for the use of a screwdriver to set housing 25.

The light 20 is fitted in a plug 21 with the positive engaging terminal contacting the batteries 22 and forms a circuit automatically, with the aid of the switch (FIG. 8), when a standard type ratchet wrench or handle is inserted in the wrench engaging end 14. The ratchet wrench or handle has a retaining spring ball fitted in a recess 31 which has a groove 15 which holds the extension in place causing the light 20 to remain illuminated automatically until the extension is removed from the ratchet wrench, handle, or another standard type extension.

The socket receiving end has a hole 29 from which the light 20 emits light through a glass lens 19 which protects the light 20 from grease or oil and can easily be cleaned.

The socket receiving end also has a retaining ball 13 which is different from the standard extension retaining ball because it is mounted on a strip of metal 18 held in place by a screw 27, and is received in a rectangular opening 17 thereby not blocking the light omitted from hole 29. The present extension, like the standard extensions, has a bevelled portion 28 on the wrench or handle receiving end to allow the retaining ball 13 to be inserted easily.

Figure 9:
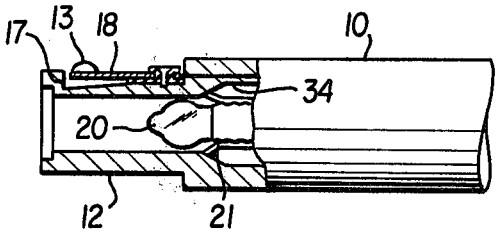
FIG. 9 is an enlarged cross-sectional view of the socket receiving end illustrating that the socket retaining assembly can be used as an alternate switch.

Referring to FIG. 9, the retaining ball 13 and metal strip 18 can be insulatingly mounted in recess 17, and can have a wire 34 attached and operatively connected with the negative terminal of the battery 22 or light bulb 20, thereby forming a switch that is operated automatically by placing a socket on the socket receiving end 12 forming a switch embodiment.

Figure 10:
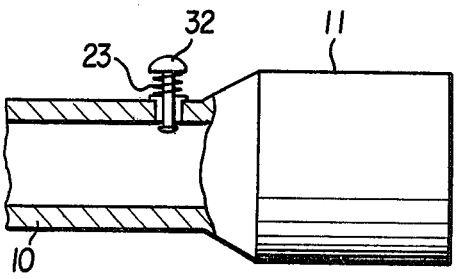
FIG. 10 is a partial cross-sectional view illustrating a modified type of switch.

Referrring to FIG. 10, a switch 32 of the finger operated momentary type can be mounted on the shank 10 on the end portion close to the handle receiving end 11 and made to come in contact with the battery retaining spring 23 to activate the light 20 when the extension is being held in the hand.

The extension of the kind described, is extremely simple in construction and will provide a convenient means for illuminating nuts, bolts, and other objects when working at night or in dark inaccessible places.

It will, of course, be understood that the invention may be made in different sizes and shapes, and constructed of any suitable material without departing from the spirit of the invention. It is not, therefore, desired to confine the invention to the exact form herein shown and described, but it is wished to include all such as properly come within the scope claimed.

I claim:

1. An extension for use with socket wrench assemblies comprising: a generally hollow, cylindrical body having a wrench receiving end and a socket receiving end; illuminating means positioned within the hollow body comprising a bulb and holder, at least one dry cell battery, a housing adapted to be secured in the wrench receiving end of the extension to retain said at least one battery and said bulb and holder in said hollow body, and a springbiased switch retained within said housing which is activated by insertion of a wrench handle into said wrench receiving end; said socket receiving end having mounted thereon a socket retaining assembly which is adapted to activate said illuminating means when a socket is placed on said socket receiving end of said extension.

2. The extension according to claim 1, wherein the socket retaining assembly comprises a recess in a surface of the socket receiving end, the socket receiving end being generally rectilinear in cross-section, a metal strip having a hemispherical protrusion formed therefrom and means to attach the strip within the recess.

3. The extension according to claim 1 further comprising a transparent disc to seal the end of the hollow core adjacent said bulb.

4. The extension according to claim 2 wherein the strip is insulatingly mounted within the recess and an insulated connector joins the strip to the illuminating source to form a switch activated by insertion into a socket.

5. The extension according to claim 1 further comprising a plunger actuated switch passing through the wall of the extension adjacent the wrench receiving end of the extension and actuatable to contact the illuminating source by compression of the plunger.

* * * * *